US005757352A

United States Patent [19]

Miyamoto et al.

[11] Patent Number: 5,757,352

[45] Date of Patent: May 26, 1998

[54] IMAGE INFORMATION CONTROL APPARATUS AND DISPLAY DEVICE

[75] Inventors: Katsuhiro Miyamoto, Isehara; Hiroshi Inoue, Yokohama, both of Japan

[73] Assignee: Canon Kabushiki Kaisha, Tokyo, Japan

[21] Appl. No.: 447,007

[22] Filed: May 22, 1995

Related U.S. Application Data

[63] Continuation-in-part of Ser. No. 266,796, Jun. 28, 1994, abandoned, which is a continuation of Ser. No. 899,702, Jun. 16, 1992, abandoned, and a continuation-in-part of Ser. No. 222,366, Apr. 4, 1994, abandoned, which is a continuation of Ser. No. 714,022, Jun. 12, 1991, abandoned.

[30] Foreign Application Priority Data

Jun. 18, 1990 [JP] Japan ..... 2-160499
Jun. 21, 1991 [JP] Japan ..... 3-150320

[51] Int. Cl.[6] ..... G09G 3/34

[52] U.S. Cl. ..... 345/101; 345/99

[58] Field of Search ..... 345/87, 94, 97, 345/98, 99, 101, 204, 208, 213; 348/792, 793

[56] References Cited

U.S. PATENT DOCUMENTS

| | | | |
|---|---|---|---|
| 4,998,099 | 3/1991 | Ishii | 340/805 |
| 5,033,822 | 7/1991 | Ooki et al. | 340/784 |
| 5,058,994 | 10/1991 | Mihara et al. | 340/784 |

FOREIGN PATENT DOCUMENTS

| | | | |
|---|---|---|---|
| 0355693 | 2/1990 | European Pat. Off. . | |
| 366153A | 2/1990 | European Pat. Off. | 340/784 |
| 0366153 | 5/1990 | European Pat. Off. . | |
| 0414960 | 3/1991 | European Pat. Off. | 340/784 |
| 0462541 | 12/1991 | European Pat. Off. . | |

OTHER PUBLICATIONS

*Flat Panel Displays and CRTs*, Lawrence E. Tannas, Jr. 1985, Van Nostrand Reinhold Company, Inc.; N.Y, N.Y; pp. 21–23.

*Primary Examiner*—Richard Hjerpe
*Assistant Examiner*—Ricardo Osorio
*Attorney, Agent, or Firm*—Fitzpatrick, Cella, Harper & Scinto

[57] ABSTRACT

A display apparatus includes a display panel having a scanning line and an information line and circuitry for generating and outputting image information periodically. A horizontal synchronizing signal determining a single period of the image information is output sequentially, with an interval between sequential outputtings. A writing time necessary for writing image information on the scanning line is determined and the writing time is divided by a corresponding interval of the horizontal synchronizing signal to obtain a quotient. The quotient is then rounded up into the next highest integer N. The apparatus then calculates a thinned out value (N-1), thins out the image information during a time corresponding to a number of periods based on the thinned out value and transfers the thinned out image information to the display panel. As a result, proper synchronization between the supply of data and the scanning of the display is provided, even for low frequency, high definition scanning.

20 Claims, 10 Drawing Sheets

DRIVER CIRCUIT OUTPUT LEVEL TABLE

| SWFDO.1 | 0 | 1 | 2 | 3 |
|---|---|---|---|---|
| OUTPUT LEVEL | VC | V3 | V4 | - |
| CWFDO.1 | 0 | 1 | 2 | 3 |
| OUTPUT LEVEL | VC | V1 | V2 | V5 |

| DRIVE VOLTAGE V | PANEL REWRITE TIME (1Hmax) | PANEL REWRITE TIME (1Hmin) |
|---|---|---|
| | | |
| - - - - - | - - - - - | |
| | | |
| $V_{K-1}$ | $1H_{K-1max}$ | $1H_{K-1min}$ |
| $V_K$ | $1H_{Kmax}$ | $1H_{Kmin}$ |
| $V_{K+1}$ | $1H_{K+1max}$ | $1H_{K+1min}$ |
| | | |
| - - - - - | - - - - - | |
| | | |

IMAGE INFORMATION CONTROL APPARATUS AND DISPLAY DEVICE

This application is a continuation-in-part of application Ser. No. 08/266,796, filed Jun. 28, 1994, now abandoned, which is a continuation of application Ser. No. 07/899,702, filed Jun. 16, 1992, now abandoned, and a continuation-in-part of application Ser. No. 08/222,366, filed Apr. 4, 1994, now abandoned, which is a continuation of application Ser. No. 07/714,022, filed Jun. 12, 1991 now abandoned.

BACKGROUND OF THE INVENTION

Field of the Invention

The present invention relates to an image information control apparatus in a display system and particularly a display system using a ferroelectric liquid crystal having a memory property.

Related Background Art

A recent liquid crystal display system used in a personal computer (PC) or a workstation (WS) has a larger screen size and a higher resolution and is required to have compatibility with an existing PC or WS.

In, e.g., recently popular IBM PC/AT machines, IBM CGA (Color Graphics Array), IBM EGA (Enhanced Graphics Array), IBM VGA (Video Graphics Array), and IBM 8514/A image adapter specifications are available as popular display modes used in the display system. These adapter specifications have different resolutions and different number of colors to be displayed.

For example, a CRT (Cathode Ray Tube) display system is known as a system capable of selectively setting the above display modes. Examples of the CRT display system are "Multisync II", "Multisync 3D", "Multisync 4D", and "Multisync 5D" available from NEC CORP. In a liquid display system for realizing a laptop PC or WS, it is difficult to cause one display system to selectively set different display modes.

In particular, a display system using a ferroelectric liquid crystal having a memory property suitable for a large screen size and a high resolution performs scan at a low frame frequency (5 to 20 Hz) so as to display information with a high resolution, as described in U.S. Pat. No. 5,058,994. This driving at the low frame frequency is achieved in synchronism with communication of image information.

At this time, when the display mode is changed, a synchronization relationship between driving at the low frame frequency and communication of image information is changed to pose a problem.

In a display system using a ferroelectric liquid crystal, the drive frequency is changed in accordance with a change in environmental temperature to compensate for temperature dependency for threshold characteristics inherent to the ferroelectric liquid crystal, and a period required to write in one-line information is changed accordingly. In order to synchronize driving at the low frame frequency and communication of image information, the end of write access of one-line information is signaled by an HSYNC signal (horizontal sync signal) to a graphic controller for managing transfer and communication of image information (information written in a VRAM under the control of a host CPU) when write access of one-line information is completed. Upon reception of the information representing the end of write access of one-line information, the graphic controller transfers one-line image information to the display system.

In order to employ the above communication system (called an external synchronization system), image information management software called a BIOS (Basic Input Output System) having a graphic controller therein must be changed.

This change may result in a loss of compatibility with CRT application software. For example, a palette (i.e., an element having a function of converting image information to color information) present in the graphic controller is accessed during a vertical blanking period of the CRT and changes color information in accordance with a CPU instruction. For this reason, when palette access is performed in accordance with the external synchronization system, color conversion timing errors occur because the vertical blanking period (every frame period) depends on the frame period of the ferroelectric liquid crystal panel, as compared with the case in which information is displayed in the CRT display system. This indicates that the color conversion speed becomes different from that in the CRT display system when application software for frequently performing screen color conversion is executed. As a result, compatibility with the CRT display system is lost in this application software. Some application software programs count the number of frames and then execute the next operations. In this case, a time difference occurs until the next operation is performed due to the same reason as described above. The processing speed in this case becomes different from that of the CRT display system, and the compatibility is therefore lost.

In a display system utilizing a ferroelectric liquid crystal, since interlaced scan is performed, the output procedures of image information from the VRAM are determined. In particular, the output procedures must be changed in accordance with a change in drive temperature, and information associated with this change is signaled to the graphic controller. Upon reception of this information, the graphic controller must interrupt VRAM access for a predetermined period of time so as to change the procedures for accessing the VRAM. This also makes it difficult to establish compatibility with the CRT display system.

On the other hand, since a ferroelectric liquid crystal has temperature characteristics, the drive waveform width (time required to perform write access) 1H or drive voltage must be controlled in accordance with the environmental temperature. In particular, control of 1H requires a special implementation due to the following reason. Although the period for transferring one-line image information is fixed in the CRT display system, the one-line image information write time (period for receiving image information) of the ferroelectric liquid crystal is changed in accordance with a change in environmental temperature and is delayed to twice to eight times the transfer period of the CRT display system (e.g., VGA).

In order to solve this problem, there is proposed a method of defining 1H as an integer multiple of the image information transfer period of the CRT display system and thinning image information every 1H scan. In another method described in EP 414960A1 to Miyamoto et al, temperature characteristics within the defined 1H are compensated by a drive voltage.

In the above system, however, since 1H is defined by the CRT display system, the 1H time change width in accordance with the environmental temperature is increased with an increase in 1H scan period of the CRT display system. During this period, when temperature compensation is performed by only the drive voltage, the drive voltage amplitude value becomes too high. This indicates that the breakdown voltage of a driver circuit for driving the ferroelectric liquid crystal must be increased, thus posing another problem. FIG. 5 shows 1H and the drive voltage as a function of the environmental temperature.

In addition, the drive voltage must be abruptly changed at a point where the 1H is changed in accordance with the environmental temperature. A voltage source for abruptly changing the drive voltage requires a long period of time to obtain a predetermined voltage value because the ferroelectric liquid crystal has a large capacitance. As a result, write access is not started until the drive voltage reaches a rated value.

SUMMARY OF THE INVENTION

It is an object of the present invention to provide a liquid crystal display system having improved compatibility with a CRT display system.

In particular, it is the principal object of the present invention to provide a temperature compensation system using a drive waveform against a change in environmental temperature.

According to the present invention, there is provided an image information control apparatus comprising:

a. first means for generating and outputting an image information transfer timing signal for controlling a transfer timing of image information;

b. second means for thinning the image information transfer timing signal transferred from the first means in accordance with an environmental temperature and outputting a thinned image information transfer timing signal;

c. third means for controlling a voltage waveform upon reception of the image information transfer timing signal; and d. fourth means for controlling the third means so that the voltage waveform is kept constant during a period of at least two continuous image information transfer timing signals output from the second means.

In other words, a display apparatus includes a display panel having a scanning line and an information line and circuitry for generating and outputting image information periodically. A horizontal synchronizing signal determining a single period of the image information is output sequentially, with an interval between sequential outputtings. A writing time necessary for writing image information on the scanning line is determined and the writing time is divided by a corresponding interval of the horizontal synchronizing signal to obtain a quotient. The quotient is then rounded up into the next highest integer N. The apparatus then calculates a thinned out value (N-1), thins out the image information during a time corresponding to a number of periods based on the thinned out value and transfers the thinned out image information to the display panel. As a result, proper synchronization between the supply of data and the scanning of the display is provided, even for the above-described low frequency, high definition scanning.

DETAILED DESCRIPTION OF THE PREFERRED EMBODIMENTS

Figure 1:
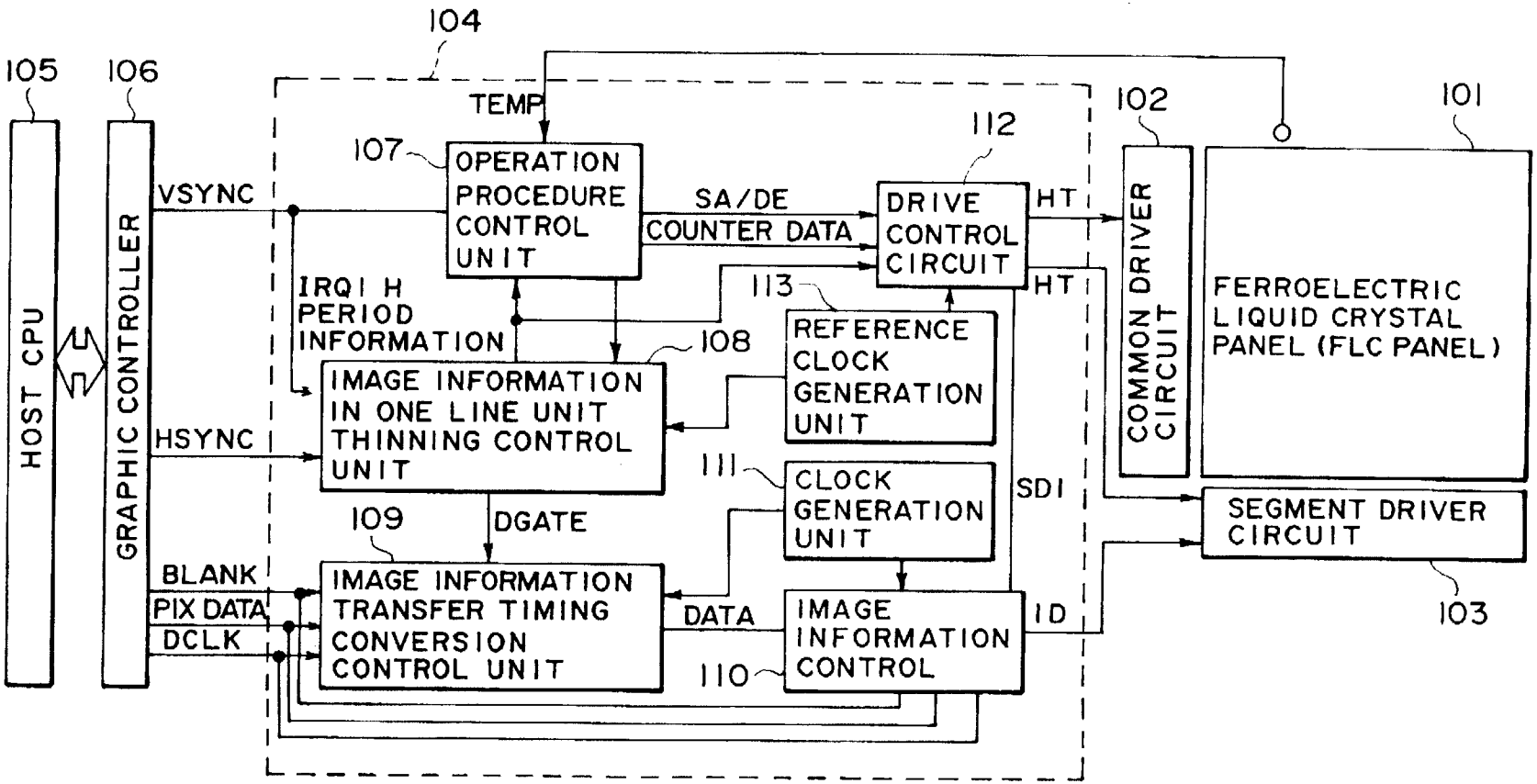
FIG. 1 is a block diagram of a drive unit according to the present invention.

FIG. 1 is a block diagram showing a display system according to the present invention. The display system includes a ferroelectric liquid crystal (FLC) panel 101, a common (scan line) driver circuit 102, a segment (information line) driver circuit 103, a control circuit 104, a host CPU (Central Processing Unit) 105 of, e.g., an IBM PC/AT machine, a graphic controller 106, an operation procedure control unit 107, an image information in one line unit thinning control unit 108, an image information transfer timing conversion control unit 109, an image information control unit 110, a transfer clock generation unit 111, a drive control unit (for controlling a write in timing for one line of the FLC panel 101) 112, a reference clock generation unit 113, and a thermo-sensor 114.

The common driver circuit 102 designates a scan address to access an arbitrary line represented by the scan address. The segment driver circuit 103 accesses an information signal corresponding to image information to a predetermined line. The graphic controller 106 comprises a VGA controller serving as a display control section of the host CPU 105. The operation procedure control unit 107 controls operation procedures of the control circuit 104. The control unit 108 thins image information from the graphic controller 106 in units of lines. The image information transfer timing conversion control unit 109 converts image information transferred from the graphic controller 106 to a transfer speed and a timing which are suitable for the segment driver circuit 103. The image information control unit 110 converts image information into pieces of image information $ID_1$, $ID_2$, . . . transferrable every predetermined period. The transfer clock generation unit 111 generates a clock signal for the segment driver circuit 103. The drive control circuit 112 outputs a control signal for forming a drive waveform suitable for the common driver circuit 102 and the segment driver circuit 103. The reference clock generation unit 113 generates a reference clock for detecting the period of an HSYNC signal (horizontal sync signal) and generating a reference signal for a drive waveform period. The thermo-sensor 114 detects the environmental temperature of the FLC panel 101.

Functions of signal lines arranged between the control circuit 104 and the graphic controller 106 will be described below. Signals on these signal lines are output from a VGA as a standard graphic controller.

(1) VSYNC (vertical sync signal): This signal is a sync signal for determining a one-frame timing.

The VSYNC period is 1/70 or 1/60 sec for VGA.

(2) HSYNC (horizontal sync signal): This signal is a sync signal for determining a one-line timing.

The HSYNC period is 31.8 μsec for VGA.

(3) BLANK (blanking signal): When the signal level of the BLANK signal is set at "H", image information is carried on PIX DATA. When the BLANK signal is set at "L" level, boarder image information is carried.

(4) PIX DATA (image information signal): This signal is an image information signal on a signal line, obtained when information written by the host CPU 105 in a VRAM (image information storage memory) in the graphic controller 106 is read out.

(5) DCLK (dot clock signal): This signal is a timing signal for determining a one-dot timing of the PIX DATA.

(Basic Operation)

Figure 2:
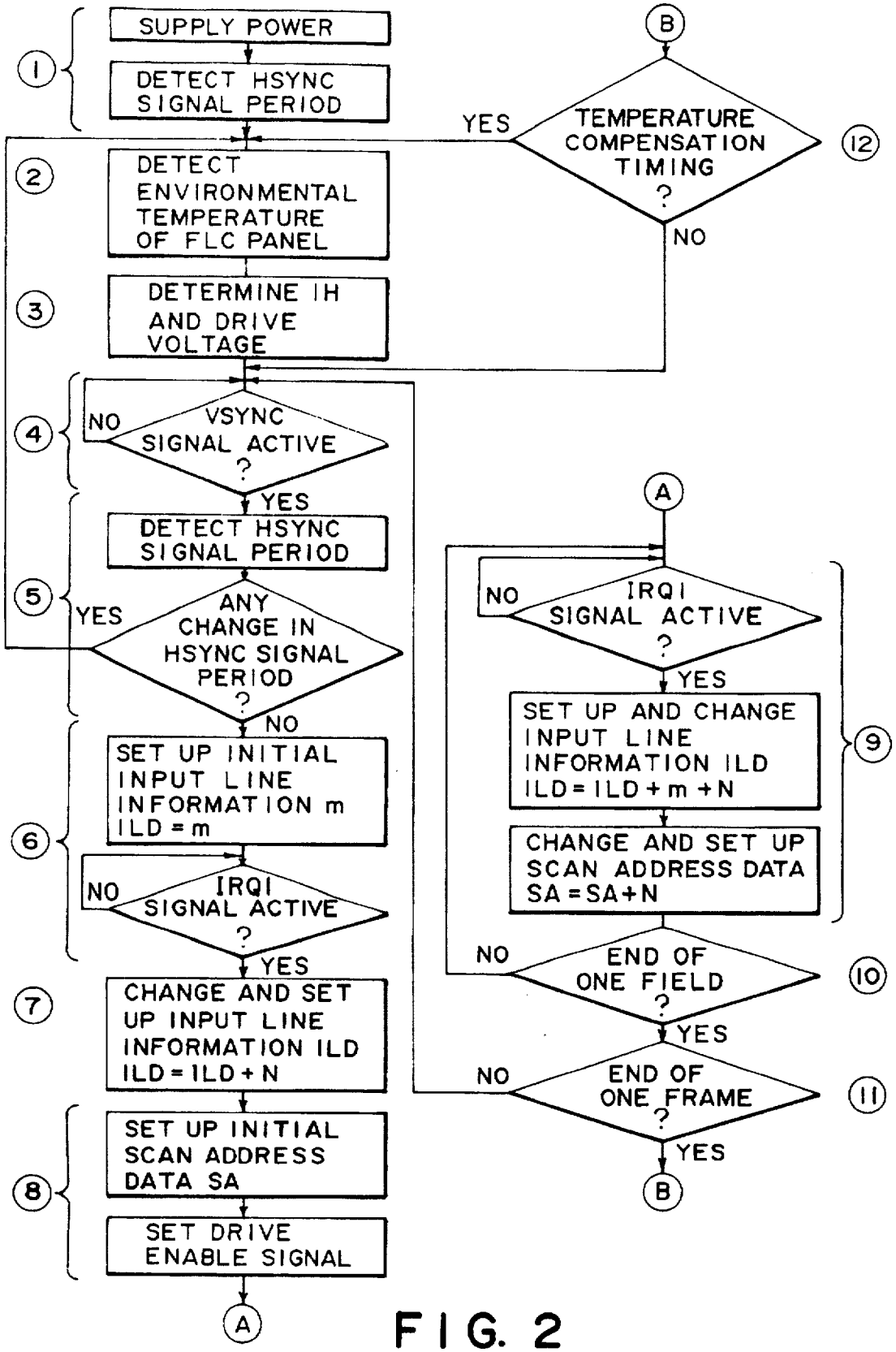
FIG. 2 is a flow chart showing a flow used in the present invention.
Figure 3:
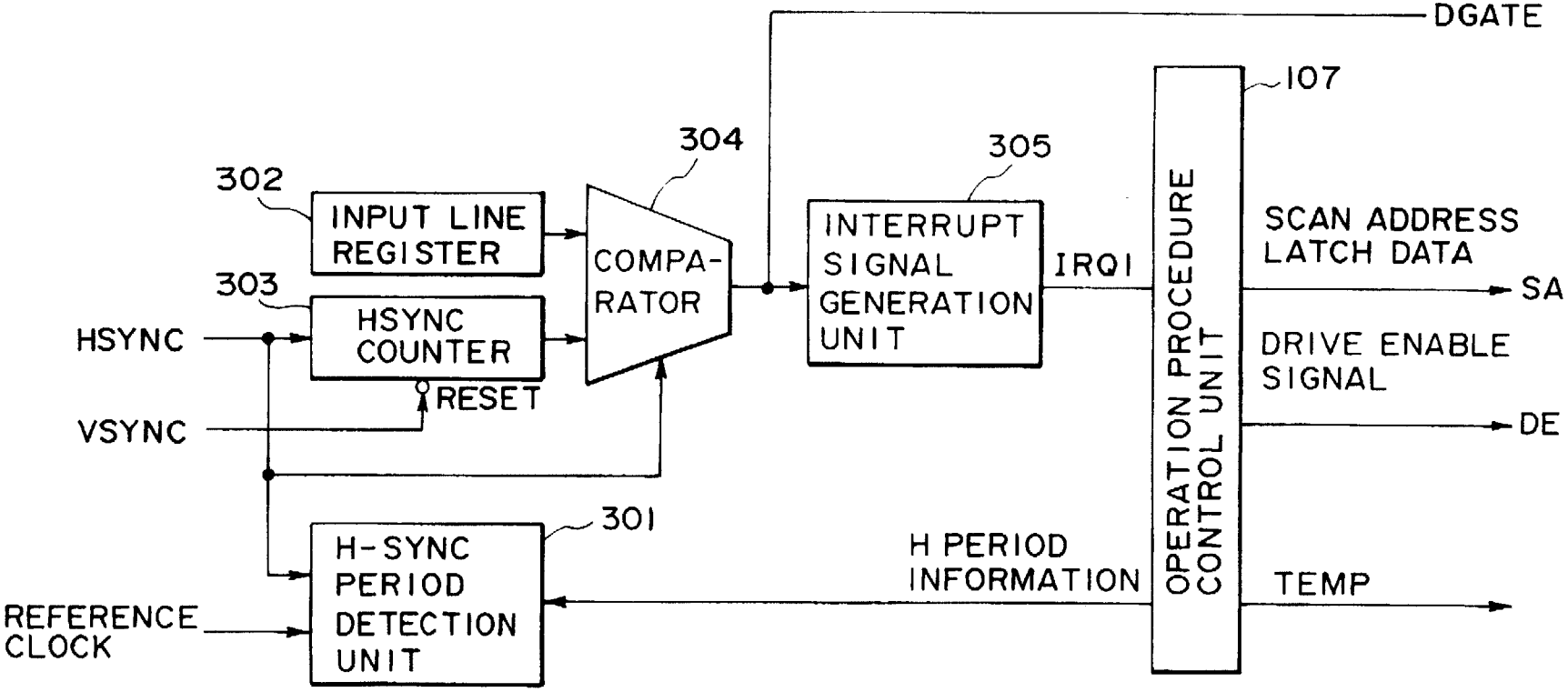
FIG. 3 is a block diagram of an operation procedure control unit used in the present invention.
Figure 4:
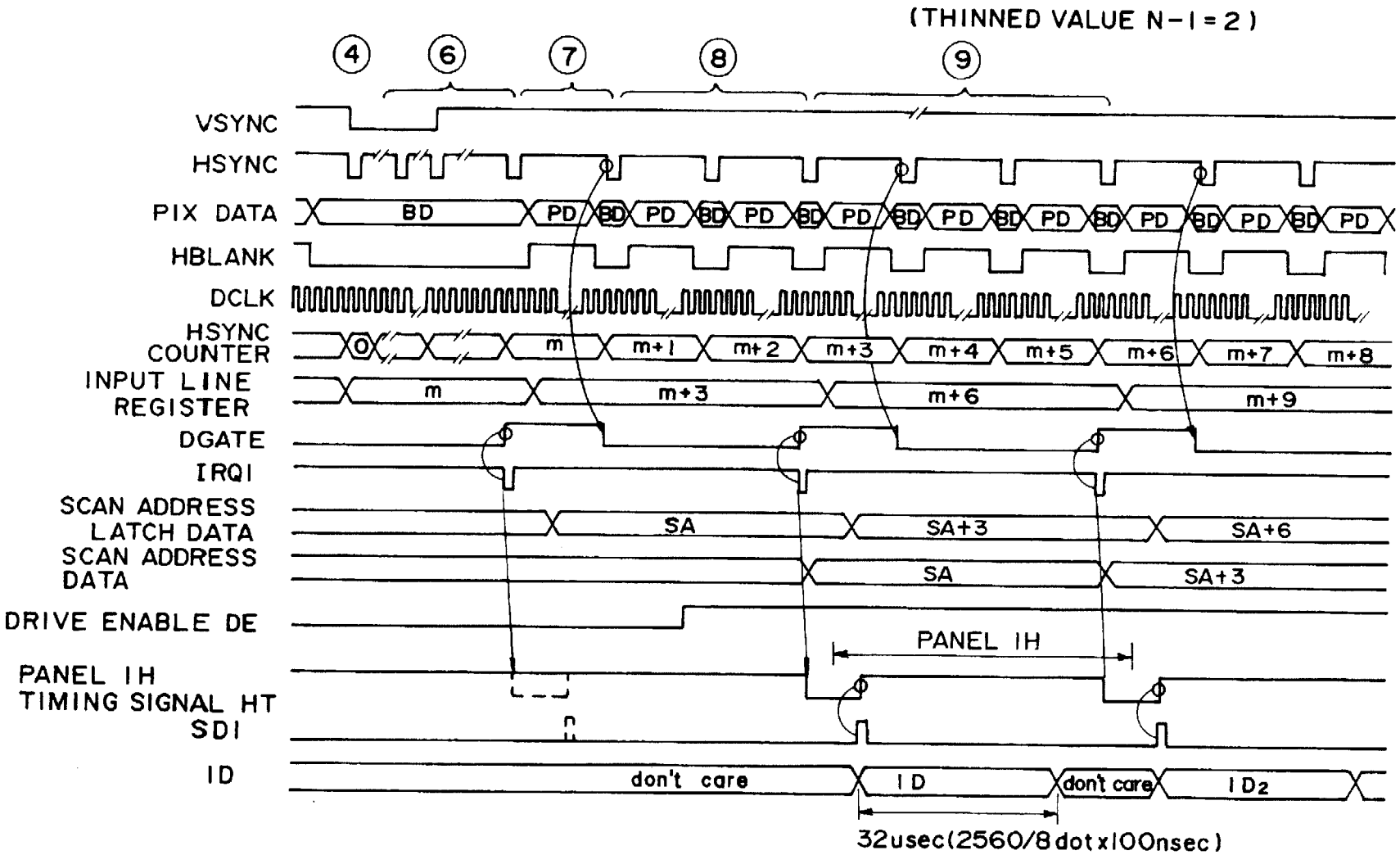
FIG. 4 is a timing chart of the operation procedure control unit used in the present invention.
Figure 5:
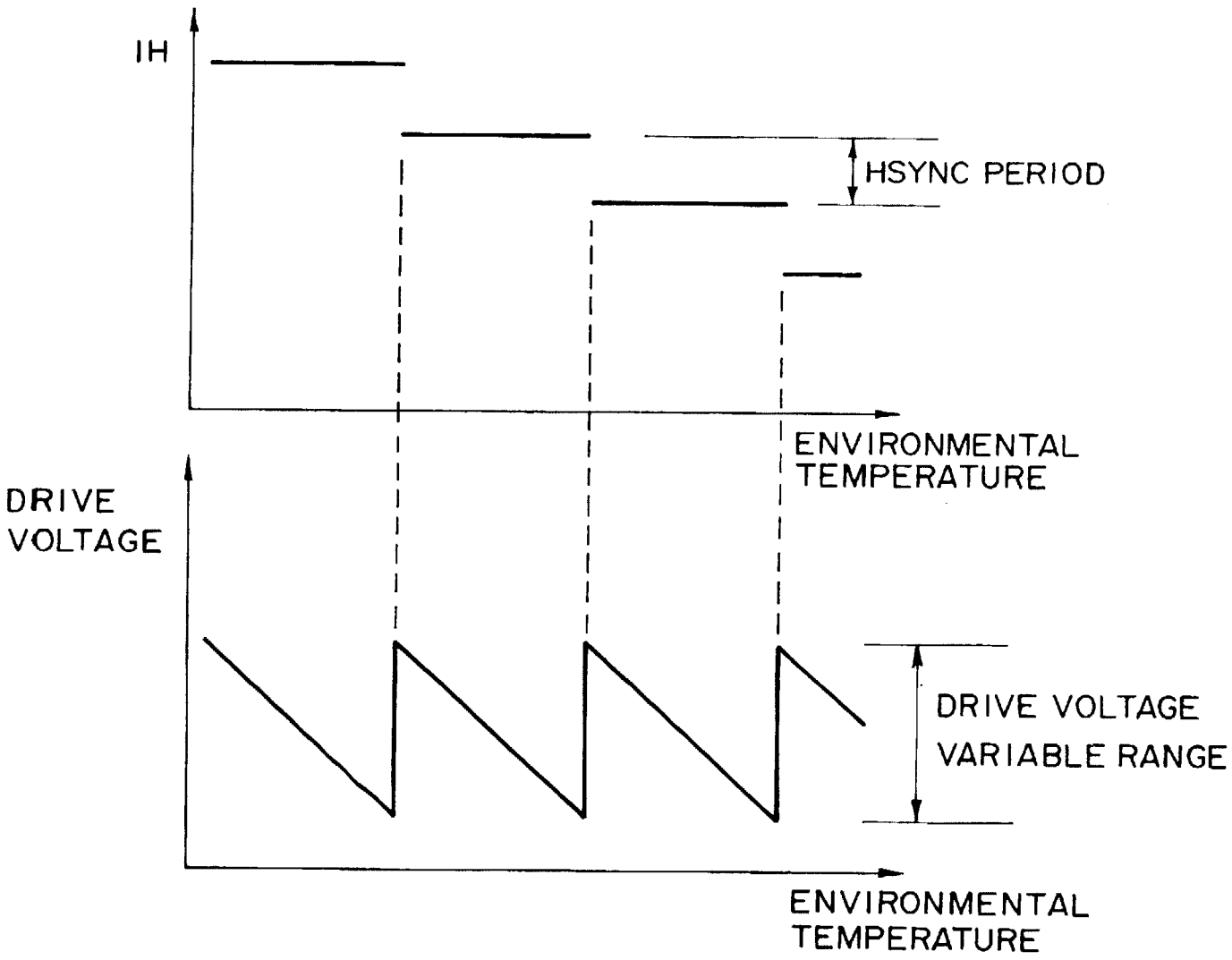
FIG. 5 is a graph showing a conventional temperature compensation relationship of 1H and the drive voltage as a function of the environmental temperature.

FIG. 2 is a flow chart showing the basic operation of the control circuit 104. FIG. 3 is a block diagram of the image information in one line unit thinning control unit 108 used in the present invention, and FIG. 4 is a timing chart of the control unit 108.

The basic operation in FIG. 2 will be described in detail below with reference to FIGS. 1, 3, and 4. Numbers in circles in FIGS. 2 and 4 represent the same operation periods. Assume that the graphic controller 106 outputs the above signals at the same timings and procedures as in the CRT display system in accordance with VRAM management software called a BIOS present in the graphic controller 106 under the control of the host CPU 105 for generating image information.

① When power is supplied, the control circuit 104 causes an H-SYNC period detection unit 301 shown in FIG. 3 to compare a reference clock from the reference clock generation unit 113 with an HSYNC signal and detect the number of reference clocks counted within the period of the HSYNC signal, thereby detecting the period of the HSYNC signal. The detection information as horizontal sync information is supplied to the operation procedure control unit 107.

② The thermo-sensor 114 senses environmental temperature information of the FLC panel 101, and Temp information as temperature information is supplied to the operation procedure control unit 107.

③ A write period (1H =one horizontal scan period) and a drive voltage V which are required for writing one-line information of the FLC panel 101 is determined from the Temp information obtained in the period ②. The method of determining these values will be described in detail later. The image information is thinned in units of lines on the basis of the determined 1H. The number of lines to be interleaved in one vertical scan period is determined in accordance with the number of thinned lines. A thinned value N-1 corresponds to the number of lines interleaved in one vertical scanning period. When the thinned value N-1 is 2, interlaced scan is performed such that the first, fourth, seventh, . . . , (3F-2)th scan lines are scanned for the first field scan in the order named, the second, fifth, eighth, . . . , (3F-1)th scan lines are scanned for the second field scan in the order named, and the third, sixth, ninth, . . . 3Fth scan lines (F=1, 2, 3, . . . integer) are scanned for the third field scan in the order named.

In the present invention, the first to third field scan cycles need not be determined in the order named. For example, a random interlacing system may be employed such that the second field scan may be the first field scan, and the first field may be the second field scan. This scan system is disclosed in U.S. Pat. No. 5,058,994. Such a multiinterlaced scan system may be incorporated in the present invention.

④ When the 1H, the drive voltage, and the thinned value are calculated, the operation procedure control unit 107 waits until a VSYNC signal output from the graphic controller 106 becomes active.

⑤ When an active VSYNC signal is detected, the operation procedure control unit 107 performs comparison of the HSYNC signal period detected in the period ① to detect the HSYNC signal period to check again if the HSYNC signal period is changed. This detection is performed because the HSYNC signal period in the graphic controller 106 may be changed by the host CPU 105. If any change is detected, the flow returns to the step corresponding to the period ②, and the procedure for changing the 1H and the drive voltage is repeated. This operation is performed every time the VSYNC signal is active.

⑥ The operation procedure control unit 107 sets, in an input line register 302, initial input line information m representing an image information output timing (this information representing a specific HSYNC signal at a timing at which image information is transmitted after the VSYNC signal becomes active) determined between the operation procedure control unit 107 and the graphic controller 106. Meanwhile, an HSYNC counter 303 is reset by the VSYNC signal and is counted up every time the HSYNC signal is input.

A count value from the HSYNC counter 303 is always input to a comparator 304 and compared with the value of the input line register 302. When these values coincide with each other, the comparator 304 outputs an "H"-level signal (DGATE signal) until the next HSYNC signal falls.

The DGATE signal is input to an interrupt signal generation unit 305. The interrupt signal generation unit 305 generates an interrupt signal, i.e., an IRQ1 signal to be input to the control unit 107 and the drive control circuit 112 at the leading edge of the DGATE signal.

⑦ When the operation procedure control unit 107 detects the IRQL signal, it can detect that one-line image information set in the input line register 302 has been transferred. Next necessary input line information is set in the input line register 302. The count value of this information is a value obtained such that a value N obtained by adding the thinned value N-1 to one is added to a previous value ILD (=m) of the input line register 302. FIG. 4 shows the timing chart for the thinned value N-1=2, and the count value set in the input line register 302 is given as ILD+3 (m+3, m+6, m+9, . . . )

On the other hand, the image information output to the PIX DATA signal line is temporarily input to the image information transfer timing conversion control unit 109.

⑧ The operation procedure control unit 107 sets, in the drive control circuit 112, initial scan address latch data SA to be written in the FLC panel 101. The operation procedure control unit 107 outputs a drive enable signal DE for driving the common driver circuit 102 to the segment driver circuit 103. When the drive enable signal DE is set at "H" level, an SDI signal (i.e., a trigger signal for transferring image information to the segment driver circuit 103) and a panel 1H timing signal HT (i.e., a signal for determining the 1H period of the FLC panel 101) output from the drive control circuit 112 are set active.

⑨ The operation procedure control unit 107 receives the control unit interrupt signal IRQ1 serving as a transfer detection signal for image information corresponding to the count value (ILD+3: m+3, m+6, m+9, . . .) of the input line register 302, when reception of this signal is detected, the operation procedure control unit 107 sets the corresponding image information in the input line register 302 and transfers it to the drive control circuit 112. When reception of the IRQL signal is detected by the operation procedure control unit 107, the control unit 107 sets scan address data (SA+N) in the input line register 302 and transfers it to the drive control circuit 112.

The drive control circuit 112 sets the scan address latch data SA set in the period ⑧ in the common driver circuit 102 in response to the IRQ1 signal. At the same time, the drive control circuit 112 generates the panel 1H timing signal HT and supplies it to both the common driver circuit 102 and the segment driver circuit 103. By this operation, the common driver circuit 102 performs deletion of the addressed scan line. Data write access corresponding to the addressed scan line is performed on the basis of the image information transferred to the segment driver circuit 103 during the next panel 1H period.

During this period, the SDI signal is output from the drive control circuit 112, and at the same time the image information DATA input at a timing in the period ⑦ from the image information transfer timing conversion control unit 109 is output to the segment driver circuit 103 through the image information control unit 110 at a speed suitable for the transfer speed of the common driver circuit 102 and the segment driver circuit 103. FIG. 4 shows timings at which 2,560-dot (one pixel is constituted by four dots to perform area gradation) image information ID is transferred to the segment driver circuit 103 at a period of 100 nsec in accordance with 8-bit parallel transfer. When the panel 1H has a speed lower than that, the segment driver circuit 103 waits at the end of transfer during the difference time.

⑩ The operation procedure control unit 107 determines whether one field (one frame when viewed from the graphic controller 106) for the FLC panel 101 is completed. For example, the number of scan lines transferred from the graphic controller 106 is counted. If this count value exceeds a value obtained by adding n to the current input data ILD, one field is determined to be completed. In this case, the flow returns to the step corresponding to the period ④ to wait for reception of a VSYNC signal and start inputting the next field data. However, if the count value is smaller than the sum, the flow returns to the step corresponding to the period ⑨, and the subsequent operations are repeated.

⑪ The operation procedure control section 107 determines whether the end of field in the period ⑩ is repeated N times. If so, the FLC panel 101 has received one-frame image information. However, if the end of field is repeated by the number of times smaller than N, processing during the period ④ is performed, and the subsequent operations are repeated. At this time, the initial input line data m is incremented by one to receive the next field data. If one of the numerical values from 1 to N is selected at random without incrementing the line data by one, random interlacing can be performed.

⑫ In the processing during the period ④, when write access of one frame is completed, the control circuit 104 determines whether a temperature compensation timing for the FLC panel 101 is set. This timing is determined with reference to the number of frames.

(Determination of 1H and Drive Voltage)

A method of controlling to maintain the drive voltage constant to perform temperature compensation as a characteristic feature of the present invention will be described below.

The 1H is determined in accordance with the environmental temperature to be an 1H period optimal for the FLC panel 101 (basic operation ②). At this time, the drive voltage (maximum value of the common-segment drive waveform) is given as a fixed value.

The thinned value N-1 upon thinning of the image information in units of lines is determined by the following equation, and this calculation is performed in the operation procedure control unit 107 (basic operation ③):

1H/HSYNC Signal Period=n

Integer Obtained by Rounding Decimal Part of n=N

By this calculation, the image information and the SYNC signal period are thinned, and the resultant values are respectively input to the segment driver circuit 103 and the drive control circuit 112. The thinning is performed by the thinning control unit 108.

When an optimal 1H value for the FLC panel 101 is selected in accordance with the environmental temperature, and image information is received at a period as an integer multiple of the HSYNC period, a time interval is formed until next driving is started at the end of 1H period.

Figure 6:
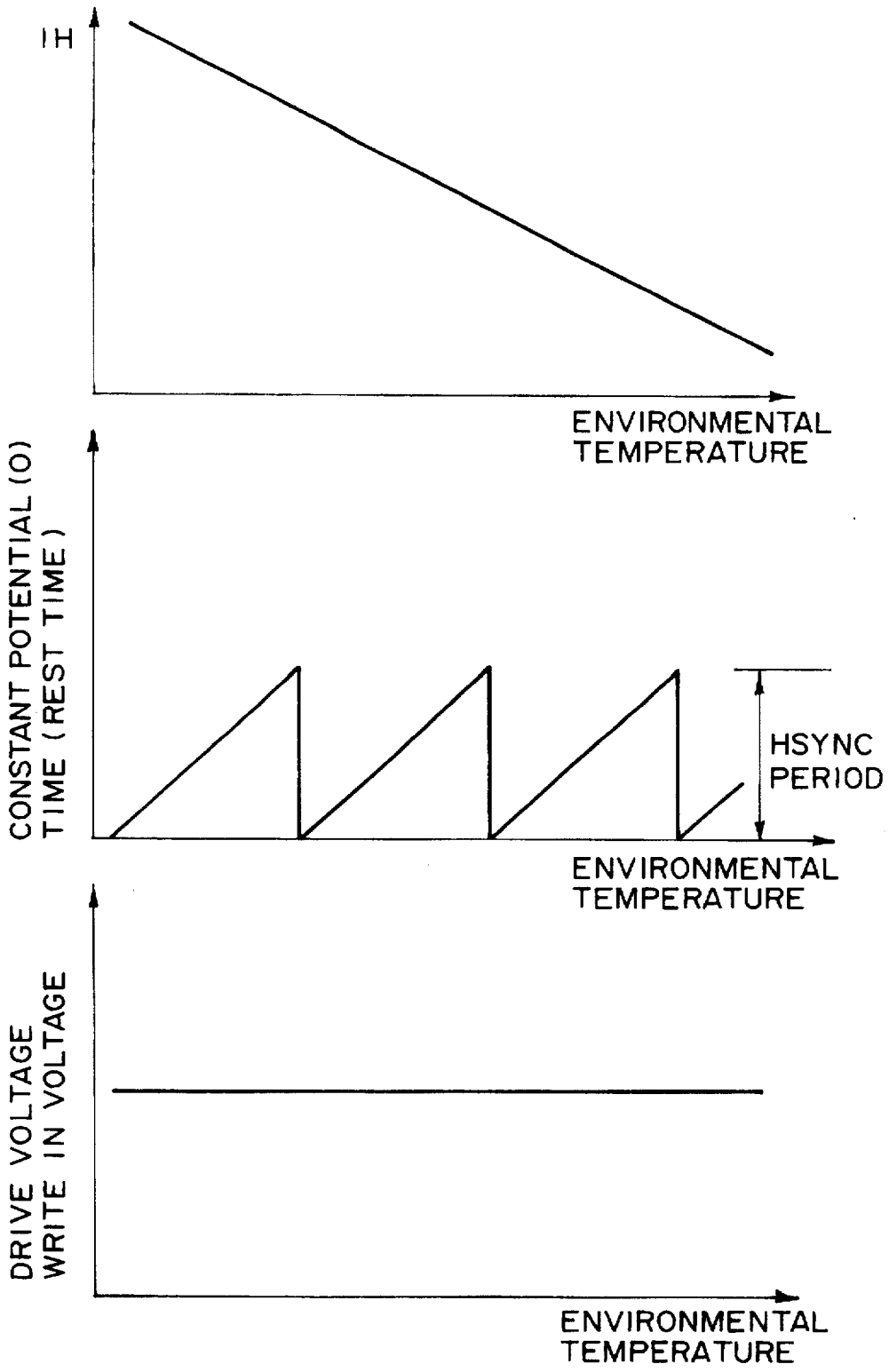
FIG. 6 is a graph showing a temperature compensation relationship of 1H and the drive voltage as a function of the environmental temperature according to the present invention.

This time interval is changed from 0 to a maximum of the SYNC signal period in accordance with a change in environmental temperature. During this time interval, the terminal potentials of the segment and common electrodes of the FLC panel 101 are controlled to be zero. Then, even if any time interval is formed, the image information will not be changed. When the 1H period is shortened with an increase in environmental temperature, the time for fixing the terminal potentials to be zero is prolonged. With this control, a waveform to be driven in synchronism with reception of the image information can be output even if the environmental temperature is changed and hence the 1H period is changed. FIG. 6 shows the relationship between 1H, the constant voltage time and the drive voltage as a function of the environmental temperature.

The above method of controlling the terminal potential of the FLC panel 101 to zero will be described below.

Figure 7:
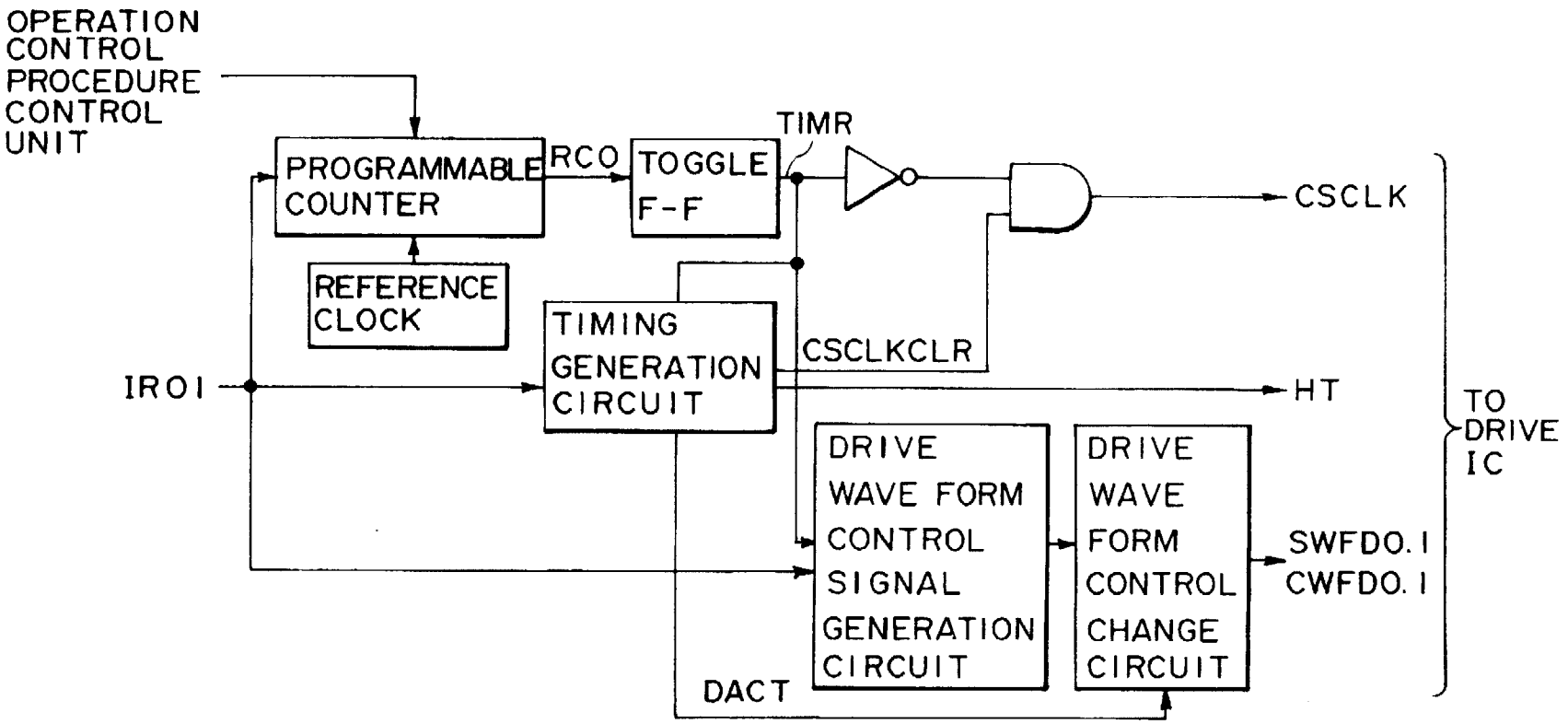
FIG. 7 is a block diagram of a drive control circuit for performing temperature compensation, used in the present invention.
Figure 8:
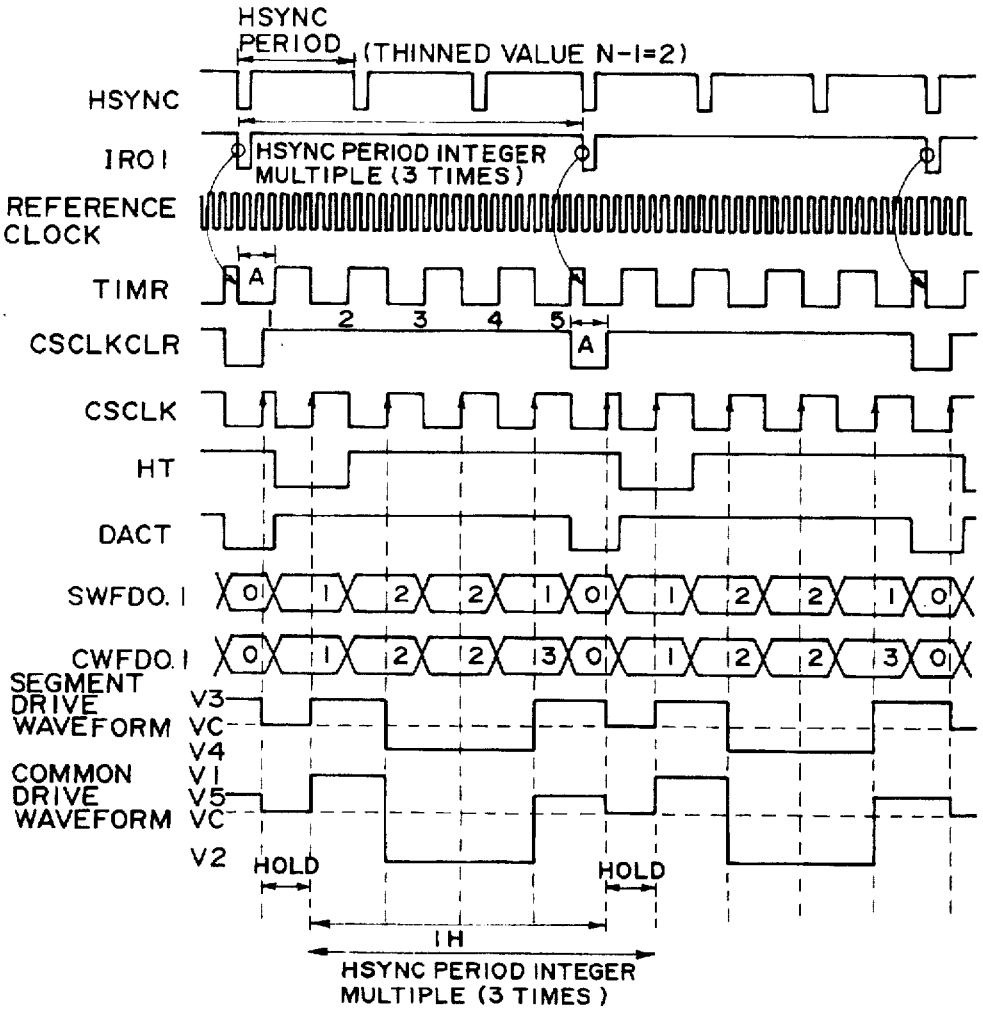
FIG. 8 is a timing chart of the drive control circuit used in the present invention.

FIG. 7 is a block diagram showing part of the drive control circuit 112, and FIG. 8 is a timing chart thereof. A description will be made with reference to FIGS. 7 and 8.

The IRQ1 signal has the same timing as that obtained when the HSYNC signal is thinned by the number of lines calculated by the 1H and the HSYNC signal. For this reason, image information is input at the period of this IRQ signal, and driving is started at this period.

As shown in FIG. 7, the operation procedure control unit 107 sets a count value in a programmable counter in accordance with information from the thermo-sensor 114. The programmable counter starts counting the reference clocks when the IRQ1 signal goes to "L" level. When the counter counts a predetermined value under the control of the operation procedure control unit 107, the counter outputs a ripple carry signal (RCO). The counter is reset again and outputs the RCO signal at a predetermined period. The RCO signal is used to generate a TIMR signal through a toggle F—F (FIG. 8). The TIMR signal is input to the drive waveform control signal generation circuit, so that the drive control signal is switched at every leading edge of the TIMR signal.

The drive control signal generation circuit is reset every time the IRQl signal goes to "L" level. The same drive control signal is repeatedly output.

On the other hand, the timing generation circuit sets a DACT signal to "H" level at the leading edge of the TIMR signal after the IRQl signal goes to "L" level. Thereafter, the timing generation circuit counts the leading edges of the TIMER signal. If the IRQ1 signal does not go to "L" level during counting of a predetermined count, the DACT signal is reset to "L" level. FIG. 8 shows a case in which the count value is 5.

The DACT signal is input to the drive waveform control change circuit. During the "L" level of this signal, a signal from the drive waveform control signal generation circuit is forcibly changed to a given value (i.e., a value for nullifying the terminal potential of the FLC panel 101) and is output to the segment and common driver circuits. This part is the important characteristic feature of the present invention.

The 1H period has the same duration as the "H" level duration of the DACT signal. This duration has a value obtained by multiplying 4 (in this embodiment) with the period of the TIMR signal. When the TIMR signal period is controlled (i.e., the counter value of the programmable counter is controlled) by the operation procedure control unit in accordance with a change in environmental temperature, the 1H period can be changed in accordance with the change in environmental temperature. Since the difference between the IRQ1 signal period and the 1H period corresponds to the "L" level duration of the DACT signal, the drive waveform control signal is forcibly changed so that the terminal potential of the panel becomes zero. As a result, the FLC panel can be maintained in a state wherein the information has been written during this duration.

Outputs SWFD0 and SWFD1 and outputs CWFD0 and CWFDl from the drive waveform control signal generation circuit are waveform control signals for the segment and common driver circuits, respectively. Values in FIG. 8 represent hexadecimal values of 2-bit signals as the signals SWFD0, SWFD1, CWFD0, and CWFD1, respectively.

The timing generation circuit resets a CSCLKCLR signal at the trailing edge of the DACT signal and sets it to "H" level again upon a lapse of the same pulse width (i.e., the period A in FIG. 8) as that of the TIMR signal. A CSCLK signal is generated from the CSCLKCLR signal and an inverted signal of the TIMR signal. The HT signal goes to "L" level at the leading edge of the first TIMR signal after the IRQ1 signal goes to "L" level. The HT signal is set to "H" level again at the leading edge of the next TIMR signal.

The segment and common driver circuits can be controlled in accordance with the above signals, i.e., SWFD0, SWFD1, CWFD0, CWFD1, CSCLK, and HT signals.

Drive waveform output timings of the driver circuit will be briefly described. The output waveform of the driver circuit is started at the leading edge of the CSCLK signal when the HT signal goes to "L" level. At this time, the level of the drive waveform is determined by the values of the SWFD0, SWFD1, CWFD0, and CWFD1 signals at the leading edge of the CSCLK signal. Thereafter, the drive waveforms of the segment and common electrodes are determined in accordance with the values of the SWFD0, SWFD1, CWFD0, and CWFD1 signals at the leading edge of the CSCLK signal.

As described above, a CRT display system output signal output from a graphic controller is received, and appropriate image information is transferred to the FLC panel 101. The terminal potential of the FLC panel 101 is forcibly set to zero (constant potential) in accordance with a change in environmental temperature, thereby performing temperature compensation without changing the drive voltage.

This indicates that driver circuit breakdown problems depending on the HSYNC signal period and write errors caused by the delay of the drive voltage upon a change in 1H can be solved.

Figure 9A:
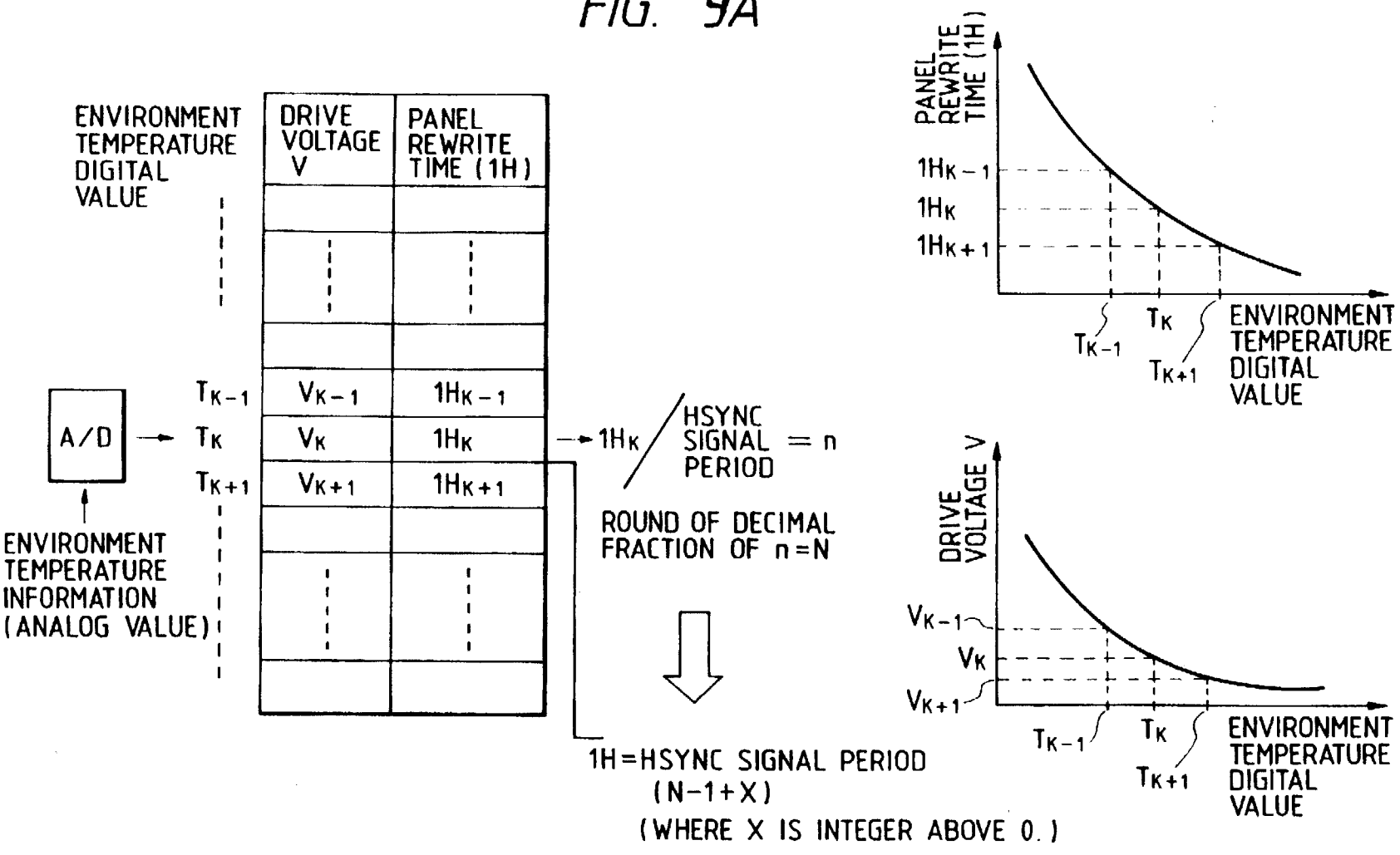
FIG. 9A shows a reference table employed in the present invention, with corresponding charts.
Figure 9B:
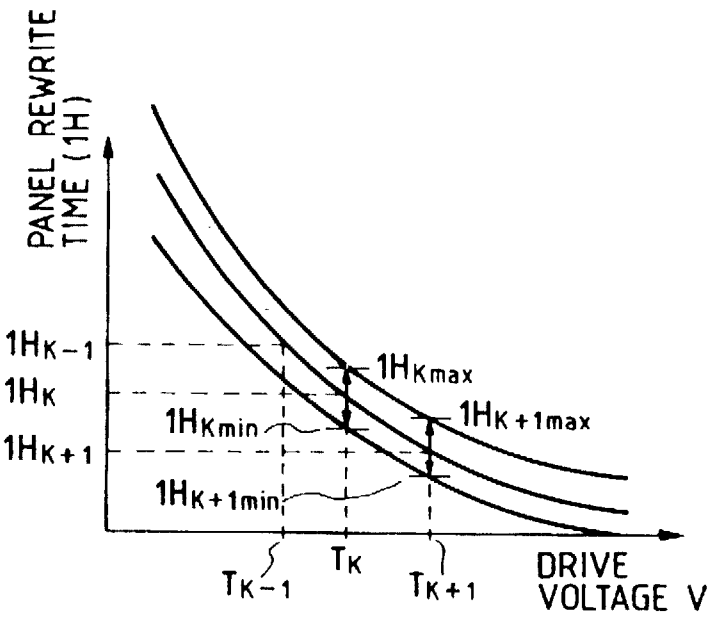
FIG. 9B shows a tolerance table for 1H employed in the present invention, with corresponding charts.

FIG. 9A shows a reference table indicating 1H and drive voltage V as a function of the ambient temperature, stored in the control unit 107, and corresponding charts, while FIG. 9B shows a table indicating the variable tolerance of 1H in relation to the drive voltage V.

1. At first, based on a digital value obtained by A/D conversion of an analog voltage corresponding to the ambient temperature, the optimum 1H and V for the FLC panel 101 are determined from the table shown in FIG. 9A.

2. The optimum values of 1H and V corresponding to a digital value Tk of the ambient temperature are respectively taken as 1Hk and Vk. A multiple N of the interval of the HSYNC signal is determined from the following equation. N-1 represents the minimum value of the image information skipping by the unit of a line (interlace value):

1Hk/HSYNC signal interval=n

N=an integer obtained by rounding up the fraction of n.

3. Then the actual skip value is determined by adding an integer X to N-1 determined in 2. X is selected as 0 if the skip value is to be minimized. Then 1H is determined by multiplying (N−1+X) by the interval of the HSYNC signal:

1H=HSYNC interval x (N−1+X).

4. If 1H determined in 3. is equal to 1Hk, Vk becomes the drive voltage V. If 1H is not equal to 1Hk but is positioned between 1Hk and 1Hk+1, the variable tolerances of 1H for Vk and Vk+1 are determined from FIG. 9B. Said tolerance is also stored in advance in the control unit 107.

5. Then there is checked whether 1H is present between $1Hk_{max}$ and $1Hk_{min}$ corresponding to Vk or between $1Hk+1_{max}$ and $1Hk+1_{min}$ corresponding to Vk+1, determined in 4., and a value V corresponding to the section containing said 1H is selected as the drive voltage V.

If both sections contain 1H, the drive voltage V is determined corresponding to 1Hk or 1Hk+1 closer to 1H.

The ferroelectric liquid crystal display panel and the driving method therefor can be those disclosed for example in the U.S. Pat. No. 4,655,561 of Kanbe et al., or in the U.S. Pat. No. 4,800,382 of Okada et al.

As explained in the foregoing, the present invention enables to achieve multiple interlaced writing in the FLC panel 101 without any change in the BIOS ROM present in the graphic controller 106 and originally designed for a cathode ray tube display system, by the use of a control circuit 104 which can transfer appropriate image information to the FLC panel and write said information thereto, only utilizing standard output signals for the cathode ray tube display system, available from the graphic controller. Therefore, even if the frame frequency for image information writing varies due to a change in the ambient temperature of the FLC panel 101, the application software for the cathode ray tube display system can be operated on the host CPU with preserved compatibility with the cathode ray tube display system.

What is claimed is:

1. A display apparatus comprising:

a) a display panel having a scanning line and an information line;

b) first means for generating and outputting image information periodically, and for generating and outputting sequentially a horizontal synchronizing signal corresponding to a single period of the image information, wherein there is an interval between sequential outputtings of the horizontal synchronizing signal;

c) second means for determining a writing time necessary for writing image information on said scanning line of said display panel;

d) third means for dividing the writing time by a corresponding interval of the horizontal synchronizing signal to obtain a quotient, and for rounding up any fraction of the quotient to obtain an integer value N;

e) fourth means for calculating a thinned out value (N-1) based on the integer N obtained by said third means, for vertically thinning out image information during a time corresponding to a number of image information period, based on the thinned out value (N-1), and for transferring the thinned out image information to said display panel; and f) fifth means for controlling a voltage applied to the scanning line and the information line so that, when a gap occurs between two sequential writing times, the voltage applied to the scanning line and the information line during the gap does not change the image information written in the first writing time.

2. An apparatus according to claim 1, wherein said scanning line and said information line are arranged with a space therebetween, and a ferroelectric liquid crystal is arranged in said space.

3. An apparatus according to claim 1, wherein a single period of the thinned out image information corresponds to the writing time of the scanning line.

4. A display apparatus comprising:

a) a display panel having a scanning line and an information line;

b) first means for generating and outputting image information periodically, and generating and outputting sequentially a horizontal synchronizing signal corresponding to a single period of the image information, wherein there is an interval between sequential outputtings of the horizontal synchronizing signal;

c) second means for determining a writing time necessary for writing image information on said scanning line of said display panel;

d) third means for dividing the writing time by a corresponding interval of the horizontal synchronizing signal to obtain a quotient n, and for rounding up any fraction of the quotient to obtain an integer value N;

e) fourth means for calculating a thinned out value (N-1) based on the integer N obtained by said third means, for vertically thinning out image information during a time corresponding to a number of image information periods, based on the thinned out value (N-1), and for transferring the thinned out image information to said display panel, so that said scanning line is scanned by skipping a number of periods of the image information (N-1) based on the thinned out value (N-1); and f) fifth means for controlling a voltage applied to the scanning line and the information line so that, when a gap occurs between two sequential writing times, the voltage applied to the scanning line and the information line during the gap does not change the image information written in the first writing time.

5. An apparatus according to claim 4, wherein said scanning line and said information line and arranged with a space therebetween, and a ferroelectric liquid crystal is disposed in said space.

6. An apparatus according to claim 4, wherein a single period of the thinned out image information corresponds to the writing time of said scanning line.

7. An apparatus according to claim 4, wherein one frame scanning is comple ted by N vertical scannings.

8. A display apparatus comprising:

a) a display panel including plural scanning lines and an information line;

b) first means for generating and outputting image information periodically, and for generating and outputting sequentially a horizontal synchronizing signal corresponding to a signal period of the image information, wherein there is an interval between sequential outputtings of the horizontal synchronizing signal;

c) second means for detecting a temperature and for determining a writing time necessary for writing one scanning line on said display panel in response to the detected temperature;

d) third means for dividing the writing time by a corresponding interval of the horizontal synchronizing signal to obtain a quotient, and for rounding up any fraction of the quotient to obtain an integer value N;

e) fourth means for calculating a thinned out value (N-1) based on the integer obtained by said third means, for vertically thinning out image information by a number of image information periods based on the thinned out value (N-1), so that scanning lines are scanned by skipping a number of periods of the image information (N-1) based on the thinned out value (N-1) to complete a field, and so that one frame scanning of the plural scanning lines is completed in N fields;

f) fifth means for controlling said second means to detect temperature after completion of one frame scanning; and g) sixth means for controlling a voltage applied to the scanning lines and the information line so that when a gap occurs between two sequential writing times, the voltage applied to the scanning lines and the information line during the gap does not change the image information written in the first writing time.

9. An apparatus according to claim 8, wherein said scanning lines and said information line are arranged with a space therebetween, and a ferroelectric liquid crystal is disposed in said space.

10. An apparatus according to claim 8, wherein a single period of the thinned out image information corresponds to the writing time of a single scanning line.

11. A display apparatus comprising:

a) a display panel including a scanning line and an information line;

b) first means for generating and outputting first image information, based on data received from a display control portion of a host computer, periodically, and for generating and sequentially outputting a horizontal synchronizing signal corresponding to a single horizontal period of said display panel during which second image information is written on said scanning line to correspond to said information line of said display panel, wherein there is an interval between sequential outputtings of the horizontal synchronizing signal;

c) second means for determining a writing time that would be necessary for writing the first image information on said scanning line of said display panel;

d) third means for dividing the writing time by a corresponding interval of the horizontal synchronizing signal to obtain a quotient, and for rounding up any fraction of the quotient to obtain an integer value N; and e) fourth means for calculating a thin out value (N-1) based on the integer value N obtained by said third means, for vertically thinning out the first image information during a time corresponding to a number of said horizontal periods, based on the thin out value (N-1), and for transferring the thinned out first image information to said display panel.

12. An apparatus according to claim 11, wherein said scanning line and said information line are arranged with a space therebetween, and a ferroelectric liquid crystal is arranged in said space.

13. An apparatus according to claim 11, wherein a single horizontal scanning period corresponds to the writing time of the scanning line.

14. A display apparatus comprising:

a) a display panel including a scanning line and an information line;

b) first means for generating and outputting first image information, based on data received from a display control portion of a host computer, periodically, and for generating and sequentially outputting a horizontal synchronizing signal corresponding to a single horizonal period of said display panel during which second image information is written on said scanning line to correspond to said information line of said display panel, wherein there is an interval between sequential outputtings of the horizontal synchronizing signal;

c) second means for determining a writing time that would be necessary for writing the first image information on said scanning line of said display panel;

d) third means for dividing the writing time by a corresponding interval of the horizontal synchronizing signal to obtain a quotient n, and for rounding up any fraction of the quotient to obtain an integer value N; and e) fourth means for calculating a thin out value (N-1) based on the integer N obtained by said third means, for vertically thinning out the first image information during a time corresponding to a number of said horizontal periods based on the thin out value (N-1), and for transferring the thinned out first image information to said display panel, so that the scanning line is scanned by jumping a number of scanning lines corresponding to the thin out value of the first image information.

15. An apparatus according to claim 14, wherein said scanning lines and said information line are arranged with a space therebetween, and a ferroelectric liquid crystal is disposed in said space.

16. An apparatus according to claim 14, wherein a single horizontal scanning period corresponds to the writing time of a scanning line.

17. An apparatus according to claim 14, wherein one frame scanning is completed by N vertical scannings.

18. A display apparatus comprising:

a) a display panel including a plurality of scanning lines and an information line;

b) first means for generating and outputting first image information, based on data received from a display control portion of a host computer, periodically, and for generating and sequentially outputting a horizontal synchronizing signal corresponding to a single horizontal period of said display panel during which second image information is written on said scanning line to correspond to said information line of said display panel, wherein there is an interval between sequential outputtings of the horizontal synchronizing signal;

c) second means for detecting a temperature and for determining a writing time necessary for writing one scanning line on said display panel in accordance with the detected temperature;

d) third means for dividing the writing time by a corresponding interval of the horizontal synchronizing signal to obtain a quotient, and for rounding up any fraction of the quotient to obtain an integer value N;

e) fourth means for calculating a thin out value (N-1) based on the integer obtained by said third means, and for vertically thinning out the first image information during a number of said horizontal periods based on the thin out value (N-1), so that the scanning lines are scanned by jumping a number of scanning lines corresponding to the thin out value of the first image information, and so that one frame scanning of different scanning lines is completed during N fields; and f) fifth means for controlling said second means to detect temperature after completion of one frame scanning.

19. An apparatus according to claim 18, wherein said scanning line and said information line are arranged with a space therebetween, and a ferroelectric liquid crystal is disposed in said space.

20. An apparatus according to claim 18, wherein a single horizontal scanning period corresponds to the writing time of a single scanning line.

* * * * *

UNITED STATES PATENT AND TRADEMARK OFFICE

CERTIFICATE OF CORRECTION

PATENT NO. : 5,757,352

DATED : May 26, 1998

INVENTOR(S): KATSUHIRO MIYAMOTO ET AL.

It is certified that error appears in the above-identified patent and that said Letters Patent is hereby corrected as shown below:

ON COVER PAGE AT [56] OTHER PUBLICATIONS

"Jr." should read --Jr.,--.

COLUMN 4

Line 10, "and" should be deleted;
Line 12, "invention, and" should read --invention;--.

COLUMN 6

Line 39, "IRQL" should read --IRQ1--;
Line 41, "Next" should read --Next,--;
Line 67, "when" should read --When--.

COLUMN 7

Line 4, "IRQL" should read --IRQ1--.

COLUMN 8

Line 64, "TIMER" should read --TIMR--.

UNITED STATES PATENT AND TRADEMARK OFFICE

CERTIFICATE OF CORRECTION

PATENT NO. : 5,757,352

DATED : May 26, 1998

INVENTOR(S): KATSUHIRO MIYAMOTO ET AL.

It is certified that error appears in the above-identified patent and that said Letters Patent is hereby corrected as shown below:

COLUMN 9

Line 24, "CWFD1" should read --CWFD1--.

COLUMN 11

Line 58, "comple ted" should read --completed--.

Signed and Sealed this

Second Day of February, 1999

*Attest:*

*Attesting Officer*

*Acting Commissioner of Patents and Trademarks*